US010414605B2

(12) United States Patent
Lee et al.

(10) Patent No.: US 10,414,605 B2
(45) Date of Patent: Sep. 17, 2019

(54) TORQUE CONTROL IN A SHEET MEDIA PICK MECHANISM

(71) Applicant: Hewlett-Packard Development Company, L.P., Houston, TX (US)

(72) Inventors: Ethan Lee, Milwaukie, OR (US); Devin Uehling, Camas, WA (US); Peter J Boucher, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 270 days.

(21) Appl. No.: 15/258,941

(22) Filed: Sep. 7, 2016

(65) Prior Publication Data

US 2018/0065822 A1 Mar. 8, 2018

(51) Int. Cl.

| | |
|---|---|
| ***B65H 7/06*** | (2006.01) |
| ***B65H 3/06*** | (2006.01) |
| ***B65H 3/52*** | (2006.01) |

(52) U.S. Cl.

CPC ..... *B65H 3/0669* (2013.01); *B65H 3/5261* (2013.01); *B65H 7/06* (2013.01); *B65H 2403/732* (2013.01); *B65H 2404/144* (2013.01); *B65H 2511/529* (2013.01); *B65H 2513/53* (2013.01); *B65H 2515/32* (2013.01)

(58) Field of Classification Search

CPC .. B65H 2403/732; B65H 3/0669; B65H 7/06; B65H 2511/529

See application file for complete search history.

(56) References Cited

U.S. PATENT DOCUMENTS

| | | | | |
|---|---|---|---|---|
| 6,168,147 | B1 | 1/2001 | Nose et al. | |
| 6,349,931 | B1 | 2/2002 | Kuo et al. | |
| 7,334,788 | B2 | 2/2008 | Sakamaki et al. | |
| 7,392,980 | B2 * | 7/2008 | Takeuchi | B65H 3/5261 271/10.01 |
| 7,481,421 | B2 | 1/2009 | Tsukamoto et al. | |
| 7,896,342 | B2 | 3/2011 | Tsukamoto et al. | |
| 9,242,816 | B2 | 1/2016 | Ito et al. | |
| 2006/0214356 | A1 * | 9/2006 | Yasukawa | B65H 3/06 271/10.13 |

* cited by examiner

*Primary Examiner* — Howard J Sanders
(74) *Attorney, Agent, or Firm* — HP Inc. Patent Department

(57) ABSTRACT

In one example, a torque control system for a sheet media pick mechanism to move a top sheet of media from a stack of media sheets into a nip between a pick roller and a separator roller. The torque control system includes a sensor to sense a number of consecutive pick failures and a controller operatively connected to the sensor to reduce a torque applied to the separator roller during a pick attempt after each pick failure in an amount corresponding to the number of consecutive pick failures sensed by the sensor.

16 Claims, 6 Drawing Sheets

TORQUE CONTROL IN A SHEET MEDIA PICK MECHANISM

BACKGROUND

A sheet media pick mechanism for a printer may include a separator pad or roller to help separate the top sheet in a stack from next-to-top sheets as the top sheet is picked from the stack and fed into the printer.

DRAWINGS

The same part numbers designate the same or similar parts throughout the figures. The figures are not necessarily to scale.

DESCRIPTION

Figure 1:
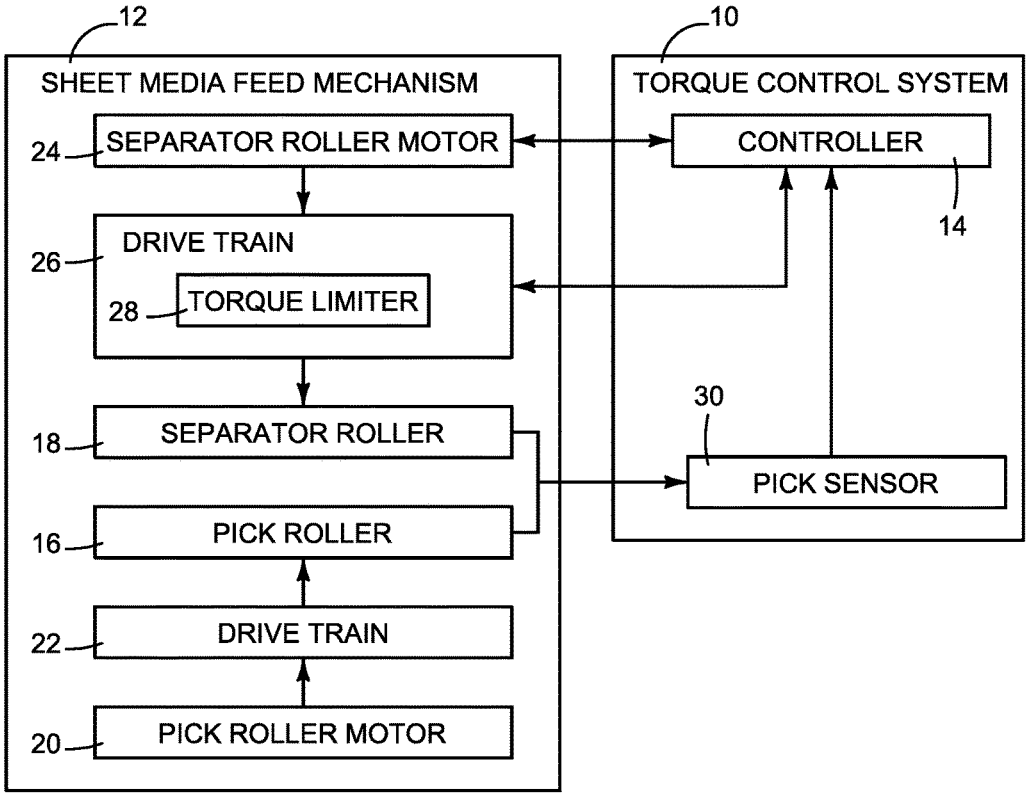
FIG. 1 is a block diagram illustrating one example of a torque control system for a sheet media pick mechanism.

The sheet media pick mechanism in some printers uses a counter-driven roller to help separate the top sheet in a stack from next-to-top sheets as the top sheet is picked from the stack and fed into the printer. The separator roller is driven counter to the pick roller to resist the media sheets advancing into a nip between the two rollers. In a successful pick, the pick roller overcomes the force of the separator roller to feed the top sheet through the nip and into the print engine. A torque limiter in the drive train for the separator roller helps enable the pick roller to overdrive the separator roller to feed the top sheet through the nip. The type or weight of the media sheets can affect pick performance. For example, the separator resistance to successfully pick a top sheet off a stack of light weight paper may be too strong to successfully pick a sheet of heavy weight paper. The thicker, stiffer heavy weight paper changes the nip dynamics and may cause the pick roller to slip on the top sheet, resulting in pick failure.

A new technique has been developed to help reduce the risk of pick failure in mechanisms that pick different types of media sheets. In one example, a torque control system for a sheet media pick mechanism reduces the torque applied to drive the separator roller during a pick attempt after each pick failure in an amount corresponding to the number of consecutive pick failures. Reducing the drive torque weakens the resistance of the separator roller to a top sheet entering the nip between the pick roller and the separator roller. The torque control system may reduce the duration and/or magnitude of the torque applied to the separator roller in a subsequent pick attempt, or the control system may reverse the direction of the torque applied to the separator roller. Thus, for example, (1) after a first pick failure, the separator drive motor is shut-off (0 torque) for some or all of the duration of the second pick attempt, (2) after a second consecutive pick failure, the separator roller is driven in the reverse direction with 1× torque for the third pick attempt; (3) after a third consecutive pick failure, the separator roller is driven in the reverse direction with 2× torque for the fourth pick attempt; and (4) after a fourth consecutive pick failure, the separator roller is driven in the reverse direction with 3× torque.

Examples of the torque control system adapt automatically by reducing torque to drive the separator roller incrementally with each successive pick failure. The new technique may be implemented, for example, through programming on the printer controller or programming on a motor controller for the separator roller (or a combination of both). Thus, examples may be implemented without additional hardware.

These and other examples described below and shown in the figures illustrate but do not limit the scope of the patent, which is defined in the Claims following this Description.

As used in this document: "and/or" means one or more of the connected things; and a "processor readable medium" is any non-transitory tangible medium that can embody, contain, store, or maintain instructions for use by a processor and may include, for example, circuits, integrated circuits, ASICs (application specific integrated circuits), hard drives, random access memory (RAM), read-only memory (ROM), and memory cards and sticks and other portable storage devices.

Figure 2:
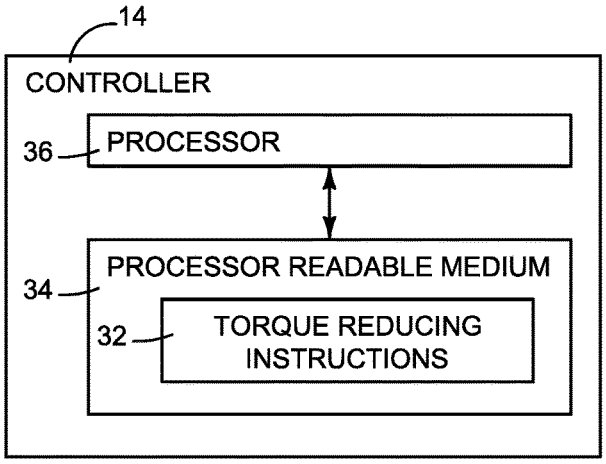
FIG. 2 is a block diagram illustrating one example for a controller in the torque control system shown in FIG. 1.
Figure 3:
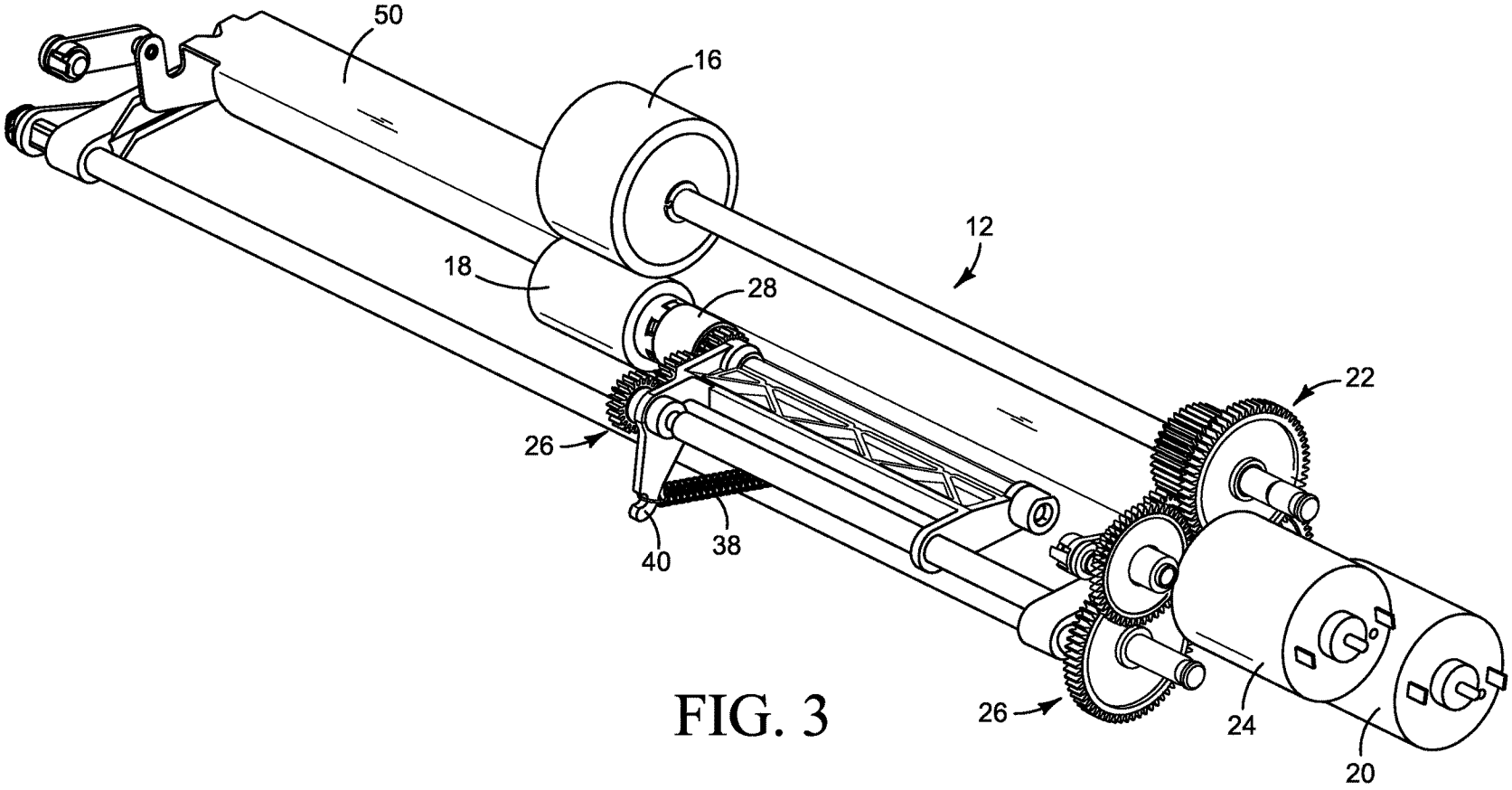
FIG. 3 is a perspective view illustrating one example of a sheet media pick mechanism used with the torque control system shown in FIG. 1.
Figure 4:
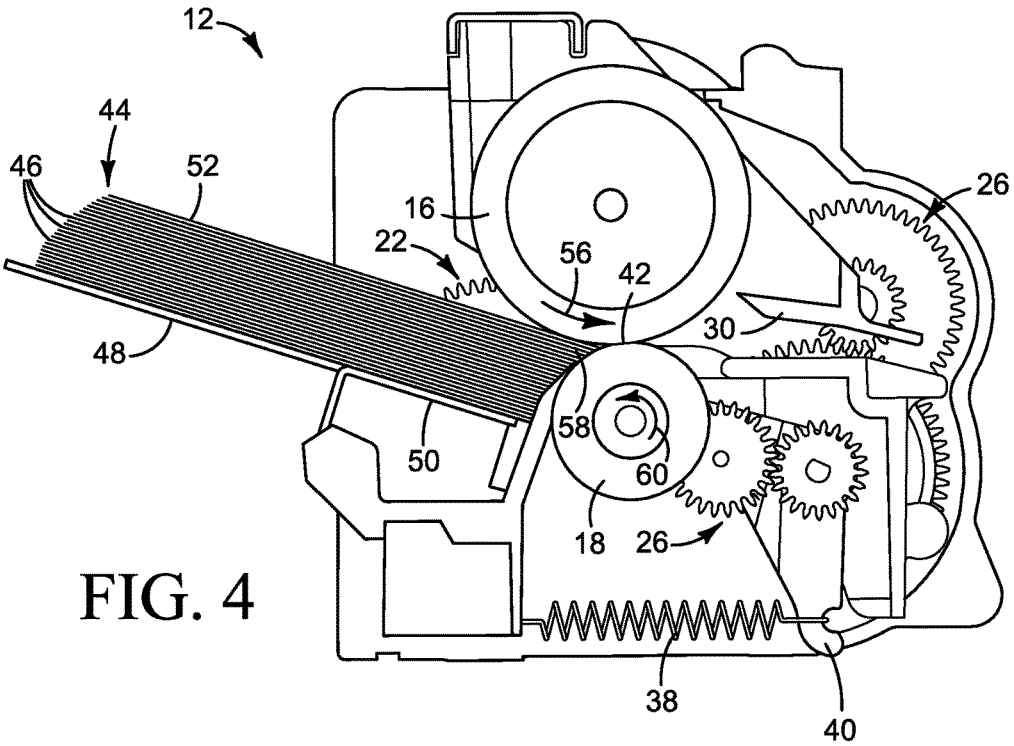
FIGS. 4 and 5 are section views illustrating one example of a sheet media pick mechanism such as that shown in FIG. 3 during a successful pick attempt.

FIG. 1 is a block diagram illustrating a torque control system 10 for a separator roller in a sheet media pick mechanism 12. FIG. 2 is a block diagram illustrating a controller 14 in torque control system 10 and FIGS. 3-7 are perspective and section views illustrating torque reduction in a pick mechanism 12. Referring first to FIG. 1, sheet media pick mechanism 12 includes a pick roller 16 and a separator roller 18. As described in more detail below with reference to FIGS. 3-7, pick roller 16 rotates against the top sheet in a stack to "pick" the top sheet from the stack and move it into a nip between the two rollers 16, 18. Separator roller 18 resists the top sheet and any next-to-top sheets dragged along with the top sheet from moving into the nip. In a successful pick, the force of pick roller 18 on the top sheet overcomes the resistance of separator roller 18 to feed the top sheet into the nip, leaving the next-to-top sheets behind. Thus, the next-to-top sheets are separated from the top sheet during the pick.

Pick mechanism 12 also includes a motor 20 and drive train 22 to drive pick roller 16, and a motor 24 and drive train 26 to drive separator roller 18. Separator roller drive train 26 usually will include a torque limiter 28 to keep the resistive force applied by separator roller 18 predictably below a desired threshold, thus allowing pick roller 16 to overdrive separator roller 18 during a successful pick. The type or weight of the media sheets can affect pick performance. For example, the resistive force applied by separator roller 18 to successfully pick a sheet of light weight paper may be too strong to successfully pick a sheet of heavy weight paper. A thicker, stiffer media changes the nip dynamics and may cause the pick roller to slip on the top sheet, resulting in pick failure. A torque control system 10 may be used to re-establish the desired nip dynamics to enable a successful pick.

Still referring to FIG. 1, torque control system 10 includes a sensor 30 to sense a pick failure and a controller 14 operatively connected to sensor 30 to reduce a torque applied to separator roller 18 during a subsequent pick attempt. Where more than one consecutive pick failures is sensed, the torque may be reduced in an increasing amount corresponding to the number of consecutive pick failures. Any suitable sensor 30 may be used to sense a pick failure including, for example, a reflective optical sensor.

As shown in the example of FIG. 2, separator roller torque reduction may be implemented through instructions 32 on a processor readable medium 34 executed by a processor 36 running on controller 14. Controller 14 may be implemented, for example, in the printer or other "global" device controller or in a "local" controller for pick mechanism 12 or separator roller drive motor 24.

Referring now to the example pick mechanism 12 FIGS. 3-7, a biasing spring 38 operatively connected to separator roller 18 through a lever arm 40 urges separator roller 18 against pick roller 16 at a nip 42. A stack 44 of paper or other media sheets 46 are supported on a tray 48 adjacent to pick roller 16. In the example shown, the forward part of sheets 46 are supported on a lift plate 50 that moves up with each pick cycle to help present a top sheet 52 to pick roller 16. In a first pick attempt, shown in FIG. 4, pick roller 16 is rotated counter-clockwise against the leading edge 54 of top sheet 52, as indicated by rotation arrow 56, to urge top sheet 52 into nip 42. A counter-clockwise drive torque is applied to separator roller 18 to resist top sheet 52 and next-to-top sheets 58 moving into nip 42, as indicated by counter-rotating drive torque arrow 60 in FIG. 4. Direction arrow 60 indicates the drive torque applied to separator roller 18, not the rotation of roller 18. Usually it will not be desirable to drive separator roller 18 with enough torque to actually counter-rotate separator roller 18 past a rotating pick roller 16. Also, the torque applied to separator roller 18 refers to the torque applied through motor 24 and drive train 26, not the overdriving torque applied by pick roller 16 during a pick attempt.

Figure 5:
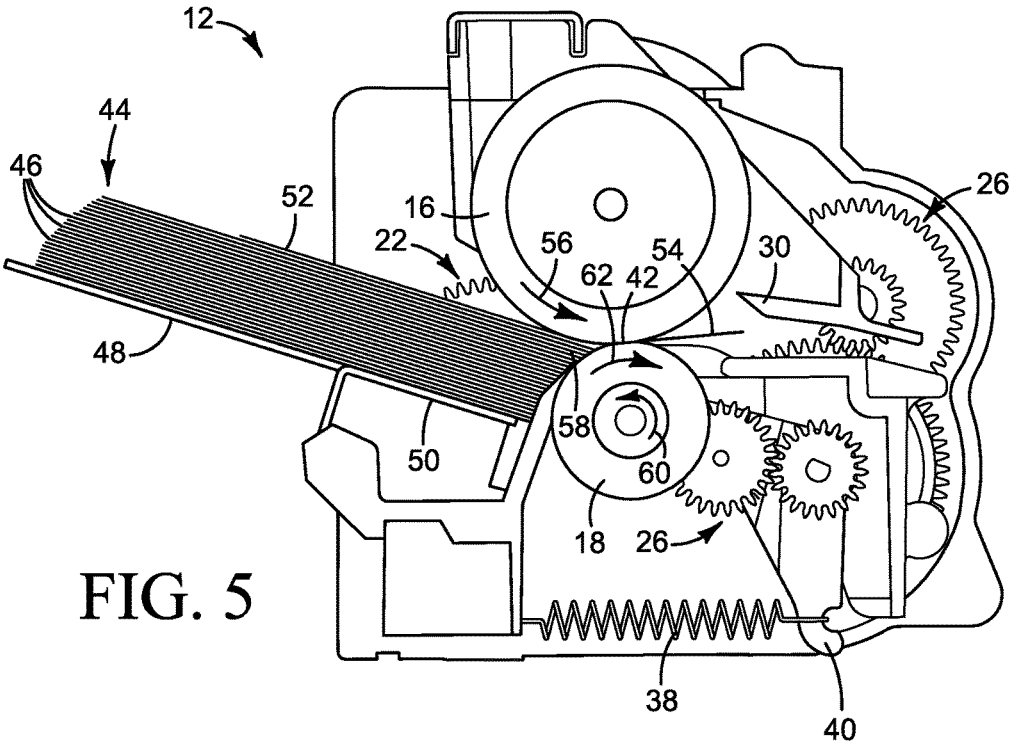
Figure 6:
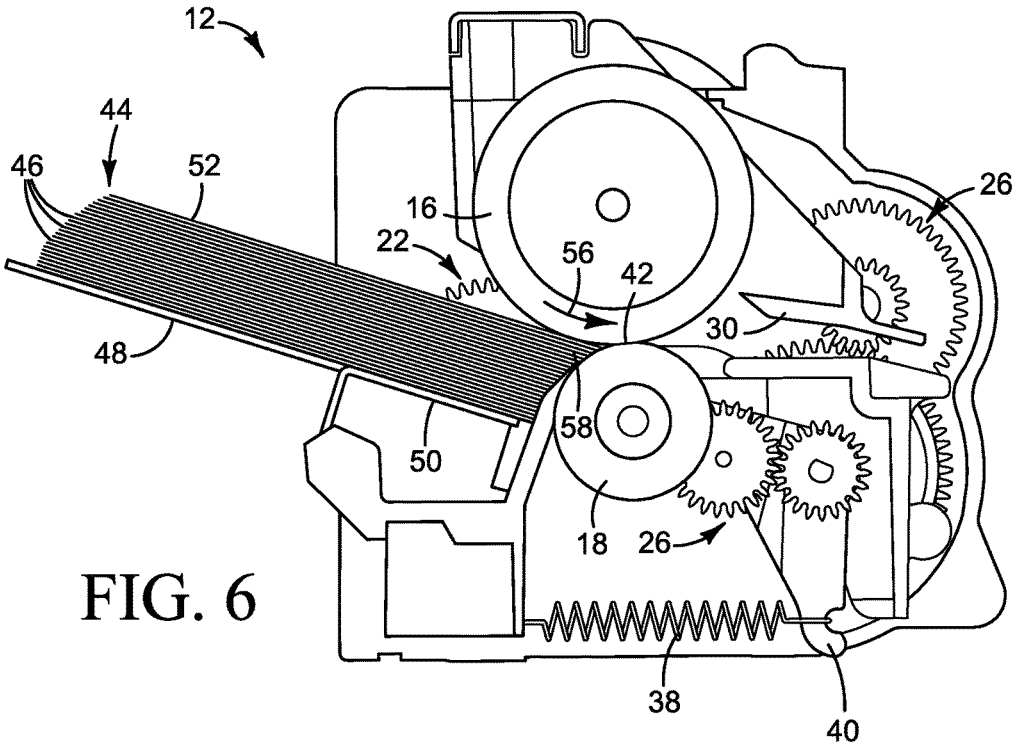
FIG. 6 is a section view illustrating one example for reducing the torque applied to the separator roller in the pick mechanism shown in FIGS. 4 and 5 during a second pick attempt after a first pick failure.

In a successful pick, as shown in FIG. 5, pick roller 16 overdrives separator 18, as indicated by rotation arrow 62, to move top sheet 52 through nip 42. The leading edge 54 of top sheet 52 is detected by sensor 30 to signal a successful pick to controller 14 (FIG. 1).

In a failed pick attempt, pick roller 16 is unable to overdrive separator roller 18, slipping on top sheet 52, and leading edge 54 is not detected by sensor 30, to signal a pick failure. In the event of a pick failure, separator roller 18 is driven at a reduced torque during a second pick attempt shown in FIG. 6 to weaken the resistance to top sheet 52 entering nip 42. In the example shown in FIG. 6, separator roller drive motor 24 is turned off so that separator roller 18 idles against pick roller 16, as indicated by the absence of a drive torque arrow for separator roller 18. If the second pick attempt is successful, pick roller 16 overdrives separator 18 to move top sheet 52 through nip 42 (as shown in FIG. 5) and sensor 30 signals a successful pick.

Figure 7:
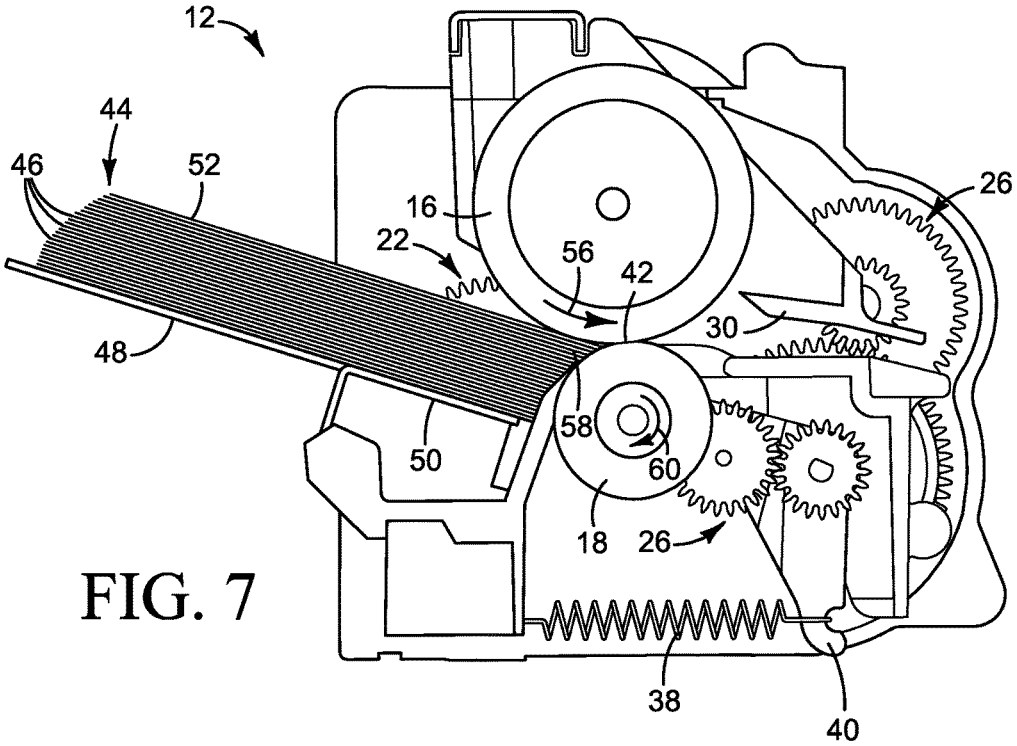
FIG. 7 is a section view illustrating one example for further reducing the torque applied to the separator roller in the pick mechanism shown in FIGS. 4 and 5 during a third pick attempt after a second pick failure.

In the event of a second pick failure, a third pick may be attempted with a further reduction in the separator roller drive torque. For example, as shown in FIG. 7, the direction of torque applied to separator roller 18 is reversed, as indicated by drive torque arrow 60 in FIG. 7, to further weaken the resistance to top sheet 52 entering nip 42. If the third pick attempt is successful, pick roller 16 overdrives separator 18 to move top sheet 52 through nip 42 (as shown in FIG. 5) and sensor 30 signals a successful pick. While it is expected that torque reduction usually will be implemented by adjusting the magnitude and/or direction of the torque output by drive motor 24, other implementations may be possible. For example, it may be desirable in some implementations to reduce the torque applied to separator roller 18 by changing the settings of torque limiter 28 and/or other elements of drive train 26.

Figure 8:
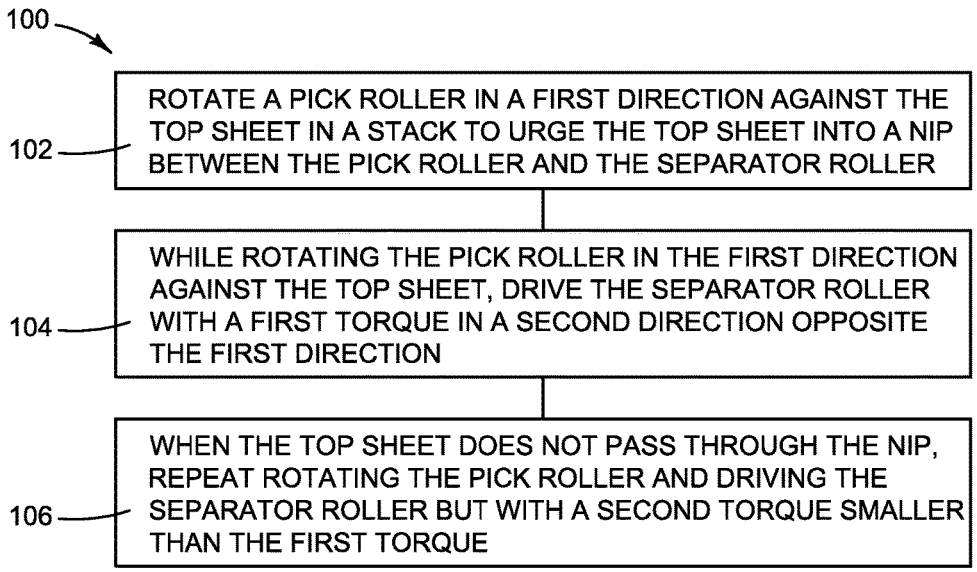
FIG. 8 is a flow diagram illustrating one example of a torque control method for a sheet media pick mechanism.

FIG. 8 is a flow diagram illustrating one example of a torque control method 100 for a sheet media pick mechanism, such as might be implemented with instructions 32 executed by a processor 36 on a controller 14 in FIG. 2. Part number references are made to the example sheet media pick mechanism shown in FIGS. 3-7. However, method 100 may be implemented in other sheet media pick mechanisms. Referring to FIG. 8, pick roller 16 is rotated in a first direction against a top sheet 52 in a stack 44 to urge top sheet 52 into nip 42 (block 102). While rotating pick roller 16 in the first direction, separator roller 18 is driven with a first torque in a second direction opposite the first direction (block 104). When top sheet 52 does not pass through nip 42, then another pick is attempted but with separator roller 18 driven with a second torque smaller than the first torque (block 106). The second, reduced drive torque may be executed, for example, by reducing the magnitude of the drive torque applied to separator roller 18, by shortening the duration of the drive torque applied to separator roller 18, and/or by reversing the direction of the drive torque applied to separator roller 18.

Figure 9:
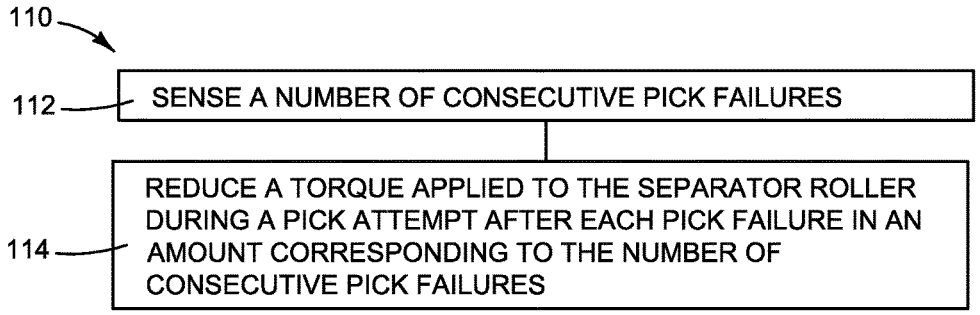
FIG. 9 is a flow diagram illustrating another example of a torque control method for a sheet media pick mechanism.

FIG. 9 is a flow diagram illustrating another example of a torque control method 110 for a sheet media pick mechanism, such as might be implement with instructions 32 executed by a processor 36 on a controller 14 in FIG. 2. Part number references are made to the example sheet media pick mechanism shown in FIGS. 3-7. However, method 110 may be implemented in other sheet media pick mechanisms. Referring to FIG. 9, sensor 30 senses a number of consecutive pick failures (block 112) and a reduced torque is applied to drive separator roller 18 during a pick attempt after each pick failure, in an amount corresponding to the number of consecutive pick failures (block 114).

Figure 10:
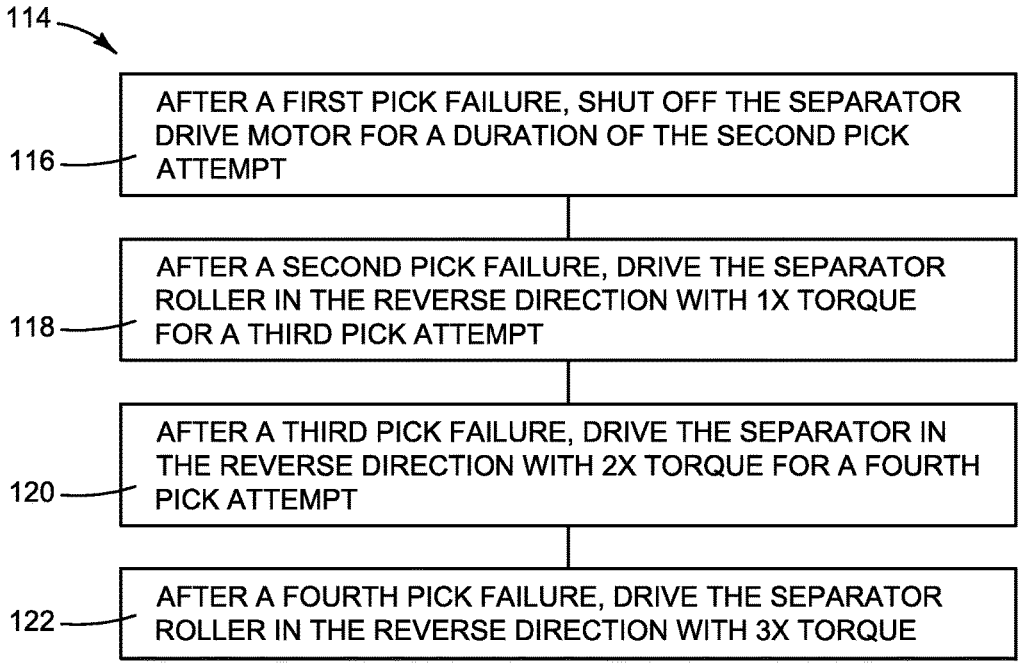
FIG. 10 is a flow diagram illustrating one example of a method for implementing the torque reduction step in the method shown in FIG. 9.

FIG. 10 is a flow diagram illustrating one example of a method for implementing torque reduction at block 114 in method 110 shown in FIG. 9. Referring to FIG. 10, after a first pick failure, separator drive motor 24 is shut off for some or all of the duration of a second pick attempt, to apply 0 torque to separator roller 18 (block 116). After a second pick failure, separator drive roller 18 is driven in the reverse direction with 1× torque for a third pick attempt (block 118). After a third pick failure, separator drive roller 18 is driven in the reverse direction with 2× torque for a fourth pick attempt (block 120). After a fourth pick failure, separator drive roller 18 is driven in the reverse direction with 3× torque for a fifth pick attempt (block 122).

"A", "an" and "the" as used in claims means one or more. For example, "a sensor" means one or more sensors and "the sensor" means the one or more sensors.

The examples shown in the figures and described above illustrate but do not limit the patent, which is defined in the following Claims.

The invention claimed is:

1. A torque control system for a sheet media pick mechanism to move a top sheet of media from a stack of media sheets into a nip between a pick roller and a separator roller, the torque control system comprising:

a sensor to sense a number of consecutive pick failures; and a controller operatively connected to the sensor, the controller to reduce a torque applied to the separator roller during a pick attempt after each pick failure in an amount corresponding to the number of consecutive pick failures sensed by the sensor.

2. The system of claim 1, where the controller to reduce the torque applied to the separator roller comprises the controller to reduce a duration of a torque applied to the separator roller during a pick attempt.

3. The system of claim 1, where the controller to reduce the torque applied to the separator roller comprises the controller to reduce a magnitude of the torque applied to the separator roller during a pick attempt.

4. The system of claim 1, where the controller to reduce the torque applied to the separator roller comprises the controller to reverse a direction of the torque applied to the separator roller during a pick attempt.

5. The system of claim 1, where the controller to reduce the torque applied to the separator roller comprises the controller to:

apply 0 torque to the separator roller during a second pick attempt; and reverse a direction of the torque applied to the separator roller during a third pick attempt.

6. A sheet media pick mechanism to pick a top sheet of media from a stack of media sheets, comprising:

a first roller and a second roller next to the first roller, the first roller to rotate in a first direction against the top sheet in the stack to urge the top sheet into a nip between the first roller and the second roller;

a motor operatively connected to the second roller through a drive train that includes a torque limiter, the motor to:

drive the second roller with a first torque in a second direction opposite the first direction while the first roller is rotating against the top sheet in the first direction; and when the top sheet does not pass through the nip, drive the second roller with a second torque different than the first torque.

7. The mechanism of claim 6, comprising a controller to control the motor to drive the second roller with the first torque and the second torque.

8. The mechanism of claim 7, comprising a sensor operatively connected to the controller to sense when the top sheet does not pass through the nip.

9. The mechanism of claim 8, where:

a direction of the second torque is the same as a direction of the first torque; and a magnitude of the second torque is smaller than a magnitude of the first torque.

10. The mechanism of claim 8, where the second torque is 0.

11. The mechanism of claim 8, where a direction of the second torque is opposite a direction of the first torque.

12. A method to pick a top sheet of media from a stack of media sheets through a nip between a pick roller and a separator roller, the method comprising:

sensing a number of consecutive pick failures; and reducing a torque applied to the separator roller during a pick attempt after each pick failure in an amount corresponding to the number of consecutive pick failures.

13. The method of claim 12, where reducing the torque applied to the separator roller includes reducing a duration of a torque applied to the separator roller during a pick attempt.

14. The method of claim 12, where reducing the torque applied to the separator roller includes reducing a magnitude of a torque applied to the separator roller during a pick attempt.

15. The method of claim 12, where reducing the torque applied to the separator roller includes reversing a direction of the torque applied to the separator roller during a pick attempt.

16. The method of claim 12, where reducing the torque applied to the separator roller includes:

reducing a magnitude of the torque applied to the separator roller during a second pick attempt; and reversing a direction of the torque applied to the separator roller during a third pick attempt.

* * * * *